US010208567B2

(12) United States Patent
Recchioni

(10) Patent No.: US 10,208,567 B2
(45) Date of Patent: Feb. 19, 2019

(54) VALVE ASSEMBLY FOR WELLBORE EQUIPMENT

(71) Applicant: Weatherford Technology Holdings, LLC, Houston, TX (US)

(72) Inventor: Matteo Recchioni, Ortona (IT)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 100 days.

(21) Appl. No.: 15/332,193

(22) Filed: Oct. 24, 2016

(65) Prior Publication Data

US 2018/0112493 A1 Apr. 26, 2018

(51) Int. Cl.

| | |
|---|---|
| ***E21B 34/14*** | (2006.01) |
| ***E21B 34/08*** | (2006.01) |
| ***E21B 34/12*** | (2006.01) |
| ***E21B 34/10*** | (2006.01) |
| ***E21B 33/14*** | (2006.01) |
| *E21B 34/00* | (2006.01) |

(52) U.S. Cl.

CPC ..... *E21B 34/12* (2013.01); *E21B 33/14* (2013.01); *E21B 34/08* (2013.01); *E21B 34/10* (2013.01); *E21B 34/103* (2013.01); *E21B 34/14* (2013.01); *E21B 2034/005* (2013.01)

(58) Field of Classification Search

CPC ..... E21B 34/063; E21B 34/103; E21B 34/14; E21B 34/08; E21B 2034/005

See application file for complete search history.

(56) References Cited

U.S. PATENT DOCUMENTS

| | | | | |
|---|---|---|---|---|
| 2,751,021 | A * | 6/1956 | Muse | E21B 21/10 137/68.17 |
| 3,148,731 | A * | 9/1964 | Holden | E21B 33/14 166/141 |
| 4,457,379 | A * | 7/1984 | McStravick | E21B 34/063 166/317 |
| 4,474,241 | A | 10/1984 | Freeman | |
| 6,401,824 | B1 | 6/2002 | Musselwhite et al. | |
| 6,679,336 | B2 | 1/2004 | Musselwhite et al. | |
| 6,684,957 | B2 | 2/2004 | Allamon | |

(Continued)

OTHER PUBLICATIONS

SUDELAC—Super BigBORE AutoFILL Float Collar Brochure, date unknown, 1 page.

(Continued)

*Primary Examiner* — Cathleen R Hutchins

(74) *Attorney, Agent, or Firm* — Patterson + Sheridan, LLP

(57) ABSTRACT

A valve assembly convertible from a first configuration to a second configuration may include a housing, a flapper attached to the housing adjustable between an open position and a closed position, a valve tubular releasably connected to the housing, an upstream barrier attached to the valve tubular and a downstream barrier attached to the valve tubular, and a tubular plug located within the valve tubular and moveable between the upstream and downstream barriers. The flapper may be in the open position when the valve assembly is in the first configuration and in the closed position when the valve assembly is in the second configuration. The upstream and downstream barriers may be positioned to prevent removal of the tubular plug from the valve tubular. The valve assembly may be used in conjunction with float equipment.

20 Claims, 4 Drawing Sheets

(56) References Cited

U.S. PATENT DOCUMENTS

| | | | |
|---|---|---|---|
| 6,712,145 | B2 | 3/2004 | Allamon |
| 7,252,152 | B2 | 8/2007 | LoGiudice et al. |
| 8,469,093 | B2 | 6/2013 | Rondeau |
| 2012/0024546 | A1 | 2/2012 | Rondeau |
| 2015/0159469 | A1 | 6/2015 | Purkis et al. |

OTHER PUBLICATIONS

PCT International Search Report and Written Opinion dated Jan. 25, 2018, for PCT/US2017/055703.

* cited by examiner

VALVE ASSEMBLY FOR WELLBORE EQUIPMENT

BACKGROUND OF THE DISCLOSURE

Field of the Disclosure

Embodiments of the present disclosure generally relate to a valve assembly. More particularly, embodiments of the present disclosure relate to a convertible valve assembly used in conjunction with wellbore equipment (for example, a float collar).

Description of the Related Art

In the drilling of oil and gas wells, a wellbore is formed using a drill bit that is urged downwardly at a lower end of a drill string. After drilling a predetermined depth, the drill string and bit are removed and the wellbore is lined with a tubular string (e.g., casing string or liner string) including tubulars (e.g., casing or liner). An annular area is thus formed between the tubular string and the wellbore. A cementing operation is then conducted in order to fill the annular area with cement. The combination of cement and tubular strengthens the wellbore, and facilitates the isolation of certain areas of the formation behind the casing for the production of hydrocarbons.

During the run-in of the tubular string, the wellbore can be damaged by surge pressure arising from displaced wellbore fluid exerting pressure on the wellbore. One way to help alleviate surge pressure is for the tubular string to be run into the wellbore at a very low, controlled speed, thus minimizing the pressure being exerted on the wellbore by displaced wellbore fluid. Another way to help alleviate surge pressure is through float equipment. A bottom of the tubular string may be equipped with float equipment designed to permit wellbore fluids to flow into the tubular while the tubular string is being lowered into the wellbore. By enabling the tubular to be filled with wellbore fluids as the tubular string is being lowered, wellbore fluid can be displaced into the tubular string, reducing surge pressure. Float equipment enables the tubular string to be run into the wellbore at an efficient speed without damaging the wellbore because of surge pressure.

While float equipment must be designed to permit wellbore fluids to flow into the tubular string during run-in, the equipment must also be convertible to a one-way valve that only permits fluids to flow out of the tubular string for the cementing operation. As discussed above, after the tubular string is positioned within the wellbore at the desired depth, a subsequent cementing operation is performed. During this cementing operation, cement slurry is pumped downstream through the tubular string and into the annular area between the tubulars and the wellbore. During this operation, the float equipment must act as a one-way check valve permitting cement slurry to be expelled from the tubular string and subsequently preventing the cement slurry from reverse flowing (also referred to as a U-tubing) back into the tubular string. Without a check valve at the bottom of the tubular string, the cement slurry will reverse flow into the tubular string if hydrostatic pressure within the annular area exceeds hydrostatic pressure within the tubular string. For example, after the cement slurry is expelled from the tubular string, hydrostatic pressure within the tubular string is sometimes relieved or reduced such that hydrostatic pressure within the annular area will exceed the hydrostatic pressure within the lining string. In this situation, the float equipment must act as the check-valve to prevent reverse flow.

One example of float equipment typically utilized with a lining string is a float collar. A float collar may include a convertible valve assembly with a valve tubular releasably connected to a valve housing. The valve assembly is configured to permit wellbore fluid to enter into the tubular string through the valve tubular during run-in, helping alleviate surge pressure within the wellbore. The valve assembly is then configured to enable the valve tubular to be released from the valve housing such that the float collar can be converted to a one-way check valve preventing cement slurry from reverse flowing from the annular area back into the tubing string. One manner of releasing the valve tubular from the valve housing is by positioning a plug catcher (e.g., a ball seat) within the valve tubular. Upon receiving a plug dropped from an upstream position (e.g., surface of the well), the plug catcher forms a fluid-tight seal enabling hydrostatic pressure within the tubular string to be increased. After the hydrostatic pressure within the tubular string reaches a certain threshold, the valve tubular will be released from the valve housing. In some situations, however, the plug catcher fails to release the valve tubular from the valve housing, thereby preventing the float collar from converting to the one-way check valve. In such situations, cement slurry from the annular area will reverse flow into the tubing string if hydrostatic pressure of the annular area exceeds hydrostatic pressure within the lining string. Therefore, there is a need for a secondary manner of releasing the valve tubular from the valve housing in the event that the plug catcher fails to operate properly to ensure that the valve assembly is converted to a one-way check valve.

SUMMARY OF THE DISCLOSURE

One embodiment of the present disclosure is a valve assembly convertible from a first configuration to a second configuration. The valve assembly includes a housing, a flapper attached to the housing, a tubular releasably connected to the housing, an upstream barrier attached to the tubular, a downstream barrier attached to the tubular, and a tubular plug. The flapper is adjustable between an open position and a closed position. The flapper is in the open position when the valve assembly is in the first configuration and in the closed position when the valve assembly is in the second configuration. The tubular is connected to the housing when the valve assembly is in the first configuration and released from the housing when the valve assembly is in the second configuration. The tubular plug is located within the tubular and movable between the upstream and downstream barriers. The upstream and downstream barriers are positioned to prevent removal of the tubular plug from the tubular.

A second embodiment of the present disclosure is a float collar. The float collar comprises a body configured to be attached to a tubular string and a valve assembly positioned within the body. The valve assembly includes a housing attached to an interior surface of the body, a flapper attached to the housing and adjustable between an open position and a closed position, a tubular releasably connected to the housing, an upstream barrier attached to the tubular, a downstream barrier attached to the tubular, and a tubular plug. A downstream portion of the tubular holds the flapper in the open position. The tubular plug is located within the tubular and movable between the upstream and downstream barriers. The upstream and downstream barriers are positioned to prevent removal of the tubular plug from the tubular. The float collar is configured to enable fluid to flow through the tubular and into the tubular string while the tubular string is being run into a well.

Another embodiment of the present disclosure relates to a method of converting a valve assembly. The method includes running a tubular string into a well, retaining the valve assembly in an open position using a valve tubular releasably attached to the housing, and pumping fluid downstream through the tubular string to urge a tubular plug away from an upstream barrier and into engagement with a downstream barrier. The tubular string has a float collar attached to a bottom end thereof. The valve assembly is oriented within the float collar and includes a housing. A tubular plug is located within the valve tubular and upstream and downstream barriers are connected to the valve tubular to prevent removal of the tubular plug from the valve tubular.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

The present disclosure generally relates to a valve assembly convertible from a first configuration to a second configuration. The valve assembly may include a housing, a flapper attached to the housing adjustable between an open position and a closed position, a valve tubular releasably connected to the housing, an upstream barrier attached to the valve tubular and a downstream barrier attached to the valve tubular, and a tubular plug located within the valve tubular and moveable between the upstream and downstream barriers. The flapper may be in the open position when the valve assembly is in the first configuration and in the closed position when the valve assembly is in the second configuration. The valve tubular may be connected to the housing when the valve assembly is in the first configuration and released from the housing when the valve assembly is in the second configuration. The housing may encompass a portion of the valve tubular when the valve assembly is in the first configuration. The upstream and downstream barriers may be positioned to prevent removal of the tubular plug from the valve tubular. The valve assembly may be used in conjunction with float equipment. For example, as will be described herein, the valve assembly may be positioned within a body of a float collar configured to be attached to a bottom end of a tubular string (e.g., a casing string). It is to be understood, however, that the valve assembly may be used in conjunction with other wellbore equipment. When the valve assembly is used in conjunction with a float collar, the valve assembly may be converted to the second configuration to prevent back flow of cement slurry into a tubular string during a cementing operation. To better understand the novelty of the valve assembly and the methods of use thereof, reference is hereafter made to the accompanying drawings.

Figure 1:
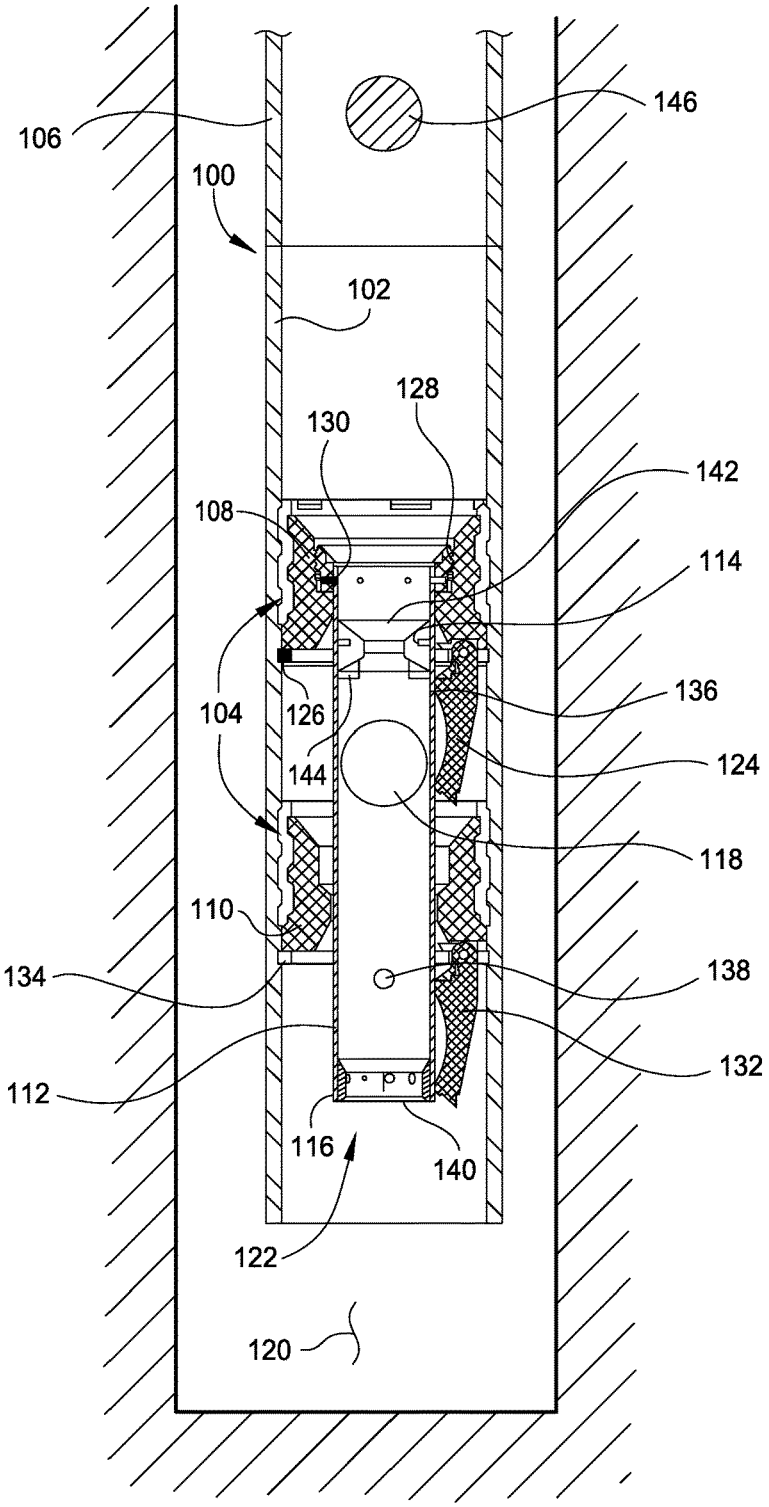
FIG. 1 illustrates a tubular string and float collar including a valve assembly in accordance with the present disclosure, with the valve assembly being in a first configuration.
Figure 2:
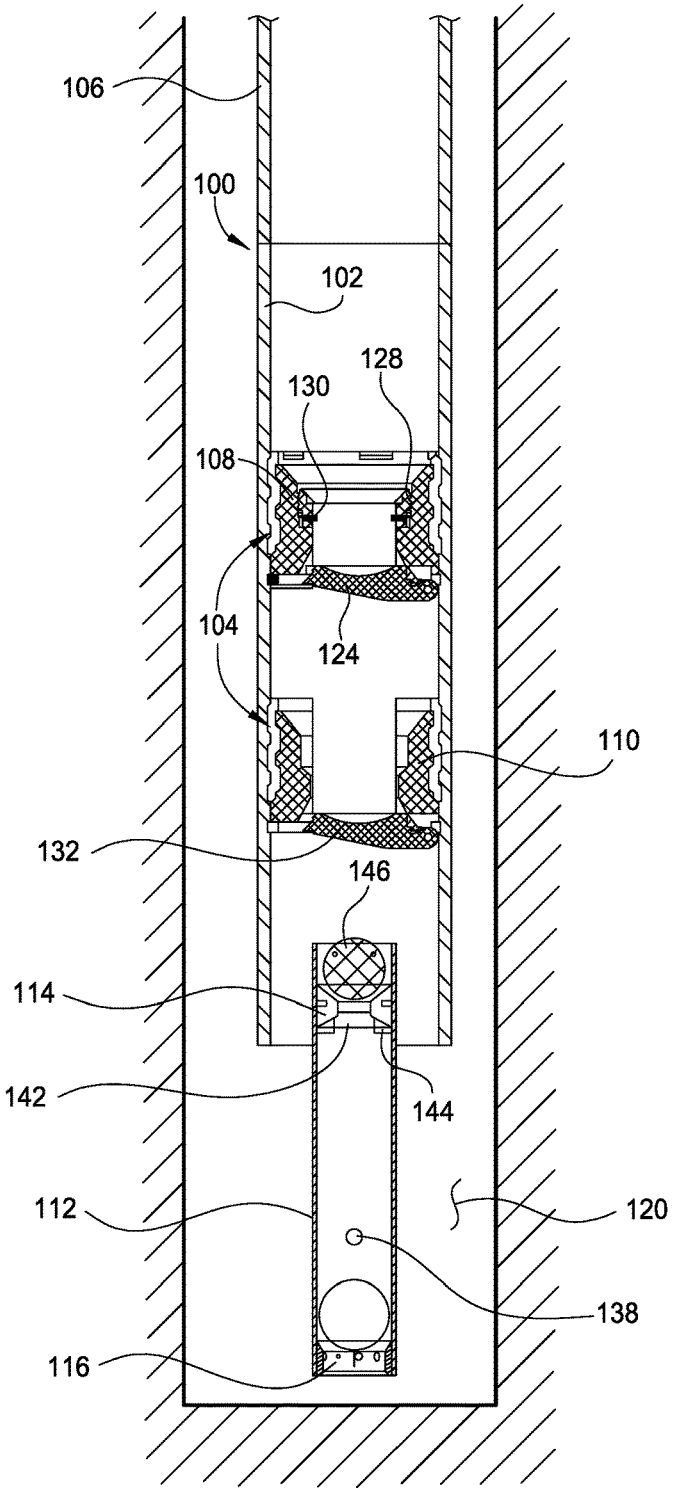
FIG. 2 illustrates the valve assembly of FIG. 1, with the valve assembly being in a second configuration.

FIGS. 1 and 2 illustrate a float collar 100. As seen in FIG. 1, the float collar 100 includes a body 102 and a valve assembly 104. The body 102 is attached to a bottom end of a tubular string 106 being run into a well. The valve assembly 104 is positioned within the body 102 and includes an upstream housing 108, a downstream housing 110, a valve tubular 112, an upstream barrier 114, a downstream barrier 116, and a tubular plug 118. It is to be understood that the valve assembly may comprise only one housing. Alternatively, the valve assembly may comprise more than two housings. The valve assembly 104 is configured to adjust between a first configuration and a second configuration. During run-in of the tubular string 106, the valve assembly 104 is in the first configuration, thus enabling wellbore fluid in wellbore 120 to flow through the valve tubular 112 and into the tubular string 106 as indicated by arrows 122.

The upstream housing 108 of the valve assembly 104 is attached to an interior surface of the body 102. In one embodiment, the upstream housing 108 may be cemented to the body 102. It is to be understood, however, that the upstream housing 108 may be attached to the body 102 in an alternative manner, such as through the use of a fastener. A flapper 124 is attached to the upstream housing 108. The flapper 124 is pivotally connected at a downstream end of the upstream housing 108. The flapper 124 is adjustable between an open position and a closed position. The flapper 124 is biased towards the closed position by a biasing spring (not shown). When the valve assembly 104 is in the first configuration shown in FIG. 1, the flapper 124 is held in the open position by the valve tubular 112. When the valve assembly 104 is in the second configuration, the flapper 124 is in the closed position (as shown in FIG. 2). A sealing ring 126 is positioned to form a fluid-tight seal with flapper 124 when the flapper is in the closed position. The upstream housing 108 further includes a connection collar 128 configured to releasably connect the valve tubular 112 via shear pins 130. The connection collar 128 is located between the upstream end of the upstream housing 108 and the downstream end of the upstream housing. Such a location of the connection collar 128 enables the valve tubular 112 to connect to the housing at an intermediate region of the upstream housing 108.

Figure 3:
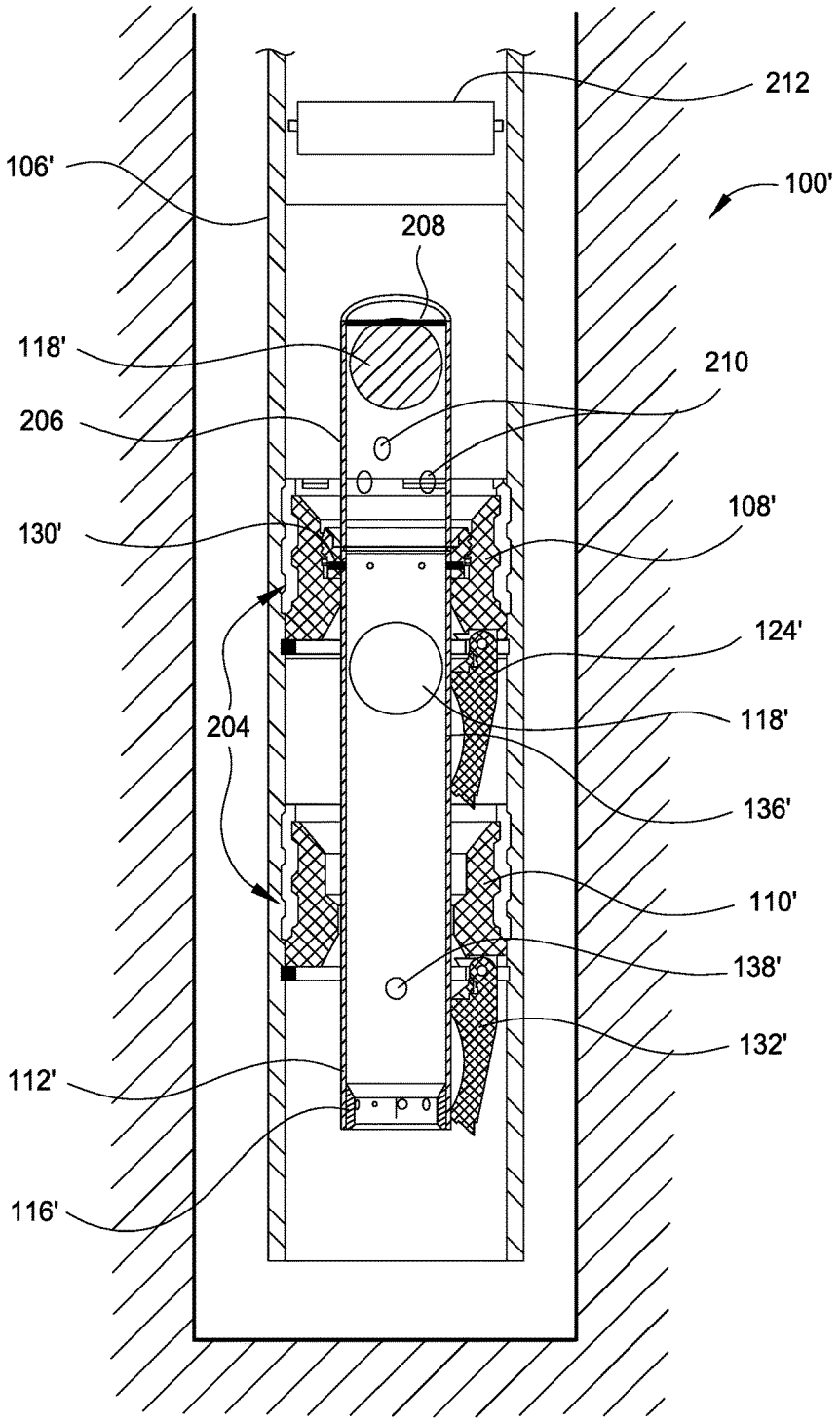
FIG. 3 illustrates a tubular string and float collar including another embodiment of a valve assembly in accordance with the present disclosure, with the valve assembly being in a first configuration.

The downstream housing 110 of the valve assembly 104 is also attached to an interior surface of the body 102. As seen in FIGS. 1 and 2, the downstream housing 110 is downstream of the upstream housing 108. In one embodiment, the downstream housing 110 may be cemented to the body 102. It is to be understood, however, that the downstream housing 110 may be attached to the body 102 in an alternative manner, such as through the use of a fastener. A flapper 132 is attached to the downstream housing 110. The flapper 132 is pivotally connected at a downstream end of the downstream housing 110. The flapper 132 is adjustable between an open position and a closed position. The flapper 132 is biased towards the closed position by a biasing spring (not shown). When the valve assembly 104 is in the first configuration shown in FIG. 1, the flapper 132 is held in the open position by the valve tubular 112. When the valve assembly 104 is in the second configuration shown in FIG. 2, the flapper 132 is in the closed position. A sealing ring 134 is positioned to form a fluid-tight seal with flapper 132 when the flapper is in the closed position. The downstream housing 110 is positioned within the body 102 downstream of the upstream housing 108 at a location that prevents the downstream housing from interfering with flapper 124 of the upstream housing as the flapper adjusts from the open position to the closed position. In FIGS. 1-3, the downstream housing is not releasably connected to the valve tubular 112. Thus, after the valve tubular 112 is released from the upstream housing 108, the valve tubular is not connected to either housing. Although the downstream housing 110 in FIGS. 1 and 2 is not shown as being releasably connected to the valve tubular 112, it is to be understood that the downstream housing could include a connection collar for releasably connecting the valve tubular to the downstream housing as well. Alternatively, it is to be understood that the valve tubular 112 could be releasably connected to the downstream housing 110 rather than the upstream housing 108.

In FIGS. 1 and 2, the valve tubular 112 is releasably connected to the upstream housing 108 via shear pins 130. The valve tubular 112 includes a downstream portion 136. The downstream portion 136 extends from the downstream end of the upstream housing 108 and passes through the downstream housing 110. As such, when the valve assembly 104 is in the first configuration, the downstream portion 136 of the valve tubular 112 holds flapper 124 of the upstream housing 108 and flapper 132 of the downstream housing 110 in the open position. In other words, when the valve assembly 104 is in the first configuration, the biasing springs of flappers 124, 132 urge the flappers into engagement with an exterior surface of the downstream portion 136 of the valve tubular 112. The valve tubular 112 may further include a port hole 138 located in the downstream portion 136. In one embodiment, the valve tubular 112 may have two port holes located downstream of the downstream housing 110, with the port holes being positioned on diametrically opposite sides of the valve tubular. The port hole 138 is configured enable the well to be circulated at a relatively low circulation rate (e.g., between 2 bbl/min to 4 bbl/min) after the tubular plug 118 forms a fluid tight seal with the downstream barrier 116 without converting the valve assembly 104 from the first configuration to the second configuration.

The tubular plug 118 is located within the valve tubular 112 and movable between the upstream barrier 114 and the downstream barrier 116. The tubular plug 118 is sized to enable the plug to move within the valve tubular 112 between the upstream and downstream barriers 114, 116. It is to be understood that the tubular plug 118 may be any type of flow-obstructing device, including, but not limited to, a ball or a dart. In the embodiment shown in FIGS. 1 and 2, the downstream barrier 116 is a plug catcher including a flow opening 140. The downstream barrier 116 is configured to receive the tubular plug 118 in a manner that forms a fluid-tight seal between the plug catcher and the tubular plug 118 such that wellbore fluid is unable to pass downstream through the flow opening 140.

In the embodiment shown in FIGS. 1 and 2, the upstream barrier 114 is also a plug catcher. The upstream barrier 114 includes a flow opening 142 and a protrusion 144 disposed at a lower end. The upper end of the upstream barrier 114 is configured to receive a secondary plug 146 flowing downstream within a well to thereby form a fluid-tight seal between the upstream barrier and the secondary plug that prevents fluid from flowing downstream within the well. Like the tubular plug, the secondary plug 146 may be any type of flow-obstructing device, including, but not limited to, a ball or a dart. As discussed in further detail below, the protrusion 144 of the upstream barrier 114 is configured to prevent the tubular plug 118 from sealing the flow opening 142 when the tubular plug engages the upstream barrier during run-in of the tubular string 106. Although the secondary plug 146 is shown in FIG. 1 as being pumped down tubular string 106 when the tubular plug 118 is positioned between the upstream and downstream barriers 114, 116, it is to be understood that the positioning of tubular plug 118 could differ from that shown in FIG. 1.

The upstream and downstream barriers 114, 116 are attached to the valve tubular 112 and positioned to prevent removal of the tubular plug 118 from the valve tubular. More specifically, the upstream barrier 114 is located within the valve tubular 112 adjacent an upstream end of the valve tubular and the downstream barrier 116 is located within the valve tubular adjacent a downstream end of the valve tubular. The upstream and downstream barriers 114, 116 may be threaded attached to the interior surface of the valve tubular 112 via threads (not shown). It is to be understood, however, that the upstream and downstream barriers 114, 116 can be attached to the valve tubular 112 in an alternative manner, for example, via fastening pins.

As seen in FIG. 1, when the tubular string 106 is being run into the wellbore 120, the valve assembly 104 within the float collar 100 is in the first configuration, enabling wellbore fluid to flow through the valve tubular 112 and into the tubular string 106 as indicated by arrows 122. As discussed above, because wellbore fluids are permitted to flow into the tubular string 106, the surge pressure associated with the run-in of the tubular string is alleviated. During the run-in operation, the tubular plug 118 within the valve tubular 112 will be urged towards the upstream barrier 114 by the wellbore fluid. The tubular plug 118 is sized to enable wellbore fluid to pass between the plug and the valve tubular 112 during run-in of the tubular string 106. In addition, as discussed above, the protrusion 144 of the upstream barrier 114 prevents the tubular plug 118 from forming a fluid-tight seal with the upstream barrier during run-in of the tubular string 106. One of ordinary skill in the art will recognize that by locating the tubular plug 118 within the valve tubular 112 during run-in, a flow obstruction may result, limiting the speed at which the tubular string 106 can be run into the well while still enabling the float collar 100 to alleviate surge pressure. Thus, it is to be understood that during run-in, a higher ratio between the diameter of the valve tubular 112 and the diameter of the tubular plug 118 is desired to minimize the effects of the flow obstruction. That said, one of ordinary skill in the art will further recognize that during the conversion operation discussed in more detail below, the tubular plug 118 should be able to form a fluid-tight seal with the downstream barrier 116 and withstand the hydrostatic pressure within the tubular string 106 required to convert the valve assembly 104 from the first configuration to the second configuration. These competing functions of the tubular plug 118 must be taken into consideration when sizing the tubular plug.

After the tubular string 106 is run-into the wellbore to the desired depth, a subsequent cementing operation is performed to fill the annular area between the tubular string and the wellbore with cement. Before commencing the cementing operation, the valve assembly 104 is converted from the first configuration (in which wellbore fluids outside of the tubular string 106 are permitted to flow into the tubular string via the valve tubular 112) to the second configuration (in which the valve assembly acts a one-way check valve that only allows fluids within the tubular string to be expelled from the tubular string). Fluid pumped downstream within the tubular string 106 urges the tubular plug 118 away from the upstream barrier 114 and towards the downstream barrier 116. Continued pumping of fluid downstream within the tubular string 106 will seat the tubular plug 118 within the downstream barrier 116, forming a fluid-tight seal between the tubular plug and the downstream barrier such that fluids cannot pass thereby.

After the tubular plug 118 is seated within the downstream barrier 116, the hydrostatic pressure within the tubular string 106 can be increased by the continued pumping of fluid downstream within the tubular string at a rate greater than that which fluid can flow through the port holes 138. As the hydrostatic pressure within the tubular string 106 increases, the pressure forces the tubular plug 118 downstream such that the tubular plug bears against the downstream barrier 116. After the hydrostatic pressure within the tubular string 106 reaches a certain threshold, the tubular plug 118 exerts enough force against the downstream barrier 116 to shear the shear pins 130 connecting the valve tubular to the upstream housing 108, thereby releasing the valve tubular from the upstream housing. After the valve tubular 112 is released, the valve tubular is pushed downstream within the well by fluid being pumped through the tubular string 106 such that the valve tubular is ejected from both the upstream and downstream housings 108, 110. The ejection of the valve tubular 112 from the housings 108, 110 permits flapper 124 and flapper 132 to close, thereby converting the valve assembly 104 from the first configuration to the second configuration.

An example pressure for converting the valve assembly 104 from the first configuration to the second configuration is in the range of approximately 500-700 psi. Alternatively, the pressure needed to convert the valve assembly could be in the range of approximately 300-400 psi. A person of ordinary skill in the art will appreciate that the required pressure for conversion of the valve assembly can be adjusted by altering the strength of the shear pins 130 connecting the valve tubular 112 to the upstream housing 108.

When the valve assembly 104 is in the second configuration, cement slurry can be expelled from the tubular string 106 into the surrounding annular area. After the cement slurry is expelled, flappers 124, 132, which are biased to the closed position by biasing springs, prevent reverse flow of the cement slurry. Thus, when the valve assembly 104 is in the second configuration, the valve assembly acts as a one-way check valve preventing reverse flow or U-tubing of the cement slurry.

Unlike a situation where a plug is dropped from a position within a well upstream of a valve assembly, the valve assembly 104 has a reduced likelihood of failing to convert from the first configuration to the second configuration because the tubular plug 118 is located within the valve tubular 112 and the upstream and downstream barriers 114, 116 are positioned to prevent the tubular plug from being removed from the valve tubular. In other words, the tubular plug 118 is less likely to fail to form a proper seal with the downstream barrier 116 enabling the tubular string 106 to be pressured up to convert the valve assembly 104 because the tubular plug is positioned within the valve tubular 112 and has restricted movement between the upstream and downstream barriers 114, 116. In some situations, however, the tubular plug 118 may still fail to engage the downstream barrier 116 in a manner that enables the tubular string 106 to be pressured up to release the valve tubular 112 from the housings 108, 110 and convert the valve assembly 104. In such a situation, the upstream barrier 114 acts as an alternative manner in which the valve tubular 112 can be released from, and ultimately ejected from, the upstream and downstream housings 108, 110.

When the tubular plug 118 fails to convert the valve assembly 104 from the first configuration to the second configuration, a secondary plug 146 can be released upstream within the well. For example, the secondary plug 146 can be released from a sea surface or subsea, depending upon the particular well operation. The secondary plug 146 is then pumped downstream, into the tubular string 106, and ultimately into the float collar 100. As discussed above, the upstream barrier 114 is configured to receive the secondary plug 146 to form a fluid-tight seal between the upstream barrier and the secondary plug.

As the secondary plug 146 is urged downstream, the secondary plug engages the upstream barrier 114 and forms a fluid-tight seal between the upstream barrier and the secondary plug such that fluid cannot pass through flow opening 142. After the seal is formed, the continued pumping of fluid downstream within the well increases the hydrostatic pressure within the tubular string 106, thus causing the secondary plug 146 to bear against the upstream barrier 114 and exert shear force on the shear pins 130 connecting the valve tubular 112 to the upstream housing 108. When the hydrostatic pressure within the tubular string 106 reaches a certain threshold, the secondary plug 146 exerts enough force against the upstream barrier 114 to shear the shear pins 130, thereby releasing the valve tubular from the upstream housing 108.

After the valve tubular 112 is released, it is pushed downstream within the well by fluid pumped downstream within the tubular string 106 such that the valve tubular is ejected from the upstream and downstream housings 108, 110. As discussed above, the ejection of the valve tubular 112 permits flapper 124 and flapper 132 to close, thereby converting the valve assembly 104 from the first configuration to the second configuration. As such, in the event that the seating of the tubular plug 118 within the downstream barrier 116 fails to enable the valve assembly 104 to be converted from the first configuration to the secondary configuration, the upstream barrier 114 provides an alternative manner for converting the valve assembly. This alternative manner ensures that the valve assembly 104 within the float collar 100 does not allow reverse flow of cement slurry during a cementing operation in the event that the tubular plug 118 fails to enable the tubular string 106 to be pressured up to a hydrostatic pressure that enables the valve assembly 104 to be converted from the first configuration to the second configuration.

Figure 4:
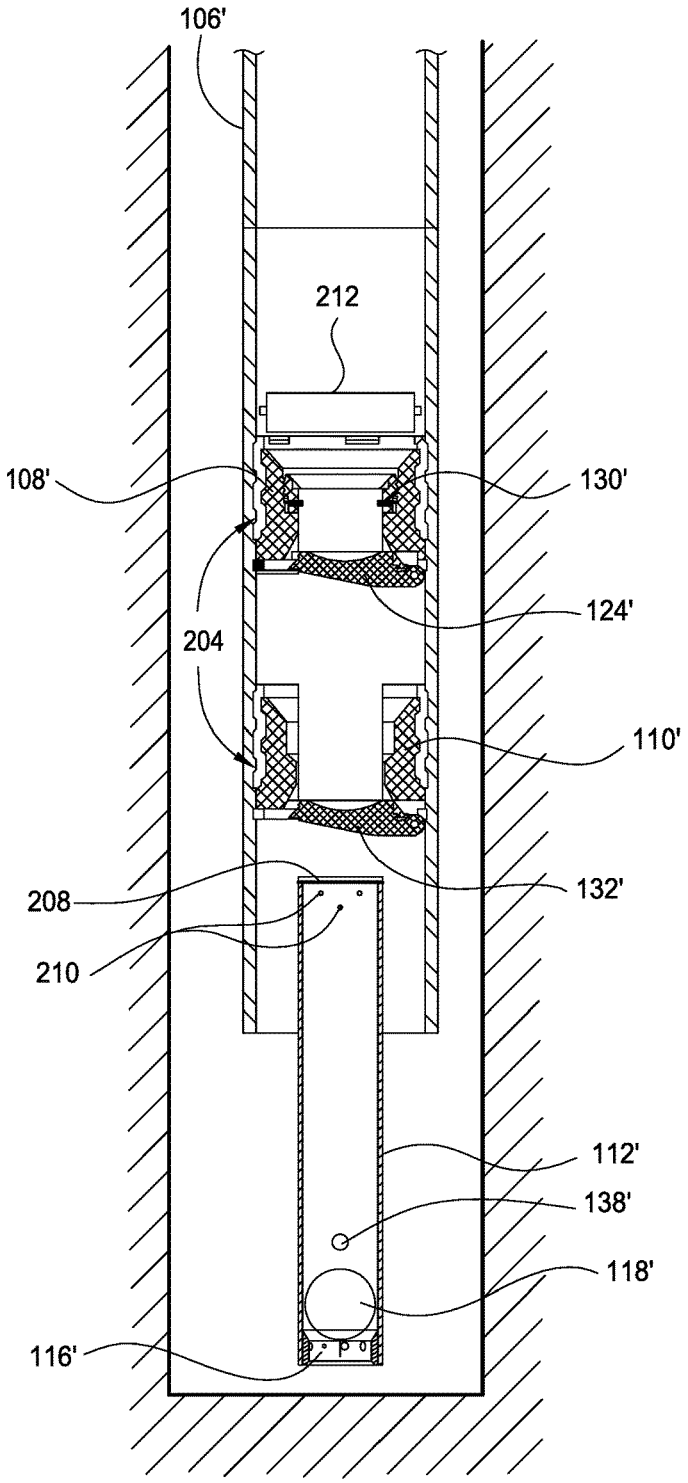
FIG. 4 illustrates the valve assembly of FIG. 3, with the valve assembly being in a second configuration.

An alternative embodiment of a valve assembly 204 in accordance with the present disclosure is shown in FIGS. 3 and 4. To the extent valve assembly 204 includes components that are the same as or similar to the components previously discussed with regard to valve assembly 104, those components will be identified by the same element number with the addition of a at the end of the element number. FIG. 3 shows tubular plug 118' in multiple positions: a position in which tubular plug 118' is located between upstream and downstream barriers 208, 116' (the tubular plug shown in solid lines) and a position in which tubular plug 118' is in engagement with the upstream barrier 208 (the tubular plug shown in cross-hatching).

In addition to having downstream portion 136' extending from the downstream end of upstream housing 108', the valve tubular 112' of the valve assembly 204 further includes an upstream portion 206 extending from an upstream end of the upstream housing 108' when the valve assembly 204 is in the first configuration. An upstream barrier 208 of the valve assembly 204 is attached to the upstream portion 206 of the valve tubular 112'. As such, the upstream barrier 208 is axially spaced from the upstream end of the upstream housing 108'. For valve assembly 204, the upstream barrier 208 is a bolt positioned to prevent tubular plug 118' from being removed from the valve tubular 112'. A person of ordinary skill in the art will understand that instead of a bolt, the upstream barrier 208 could consist of a one or more protrusions positioned circumferentially around the valve tubular 112' in a manner preventing removal of the tubular plug 118' from an upstream end of the valve tubular.

As can be seen in FIG. 3, the upstream portion 206 of the valve tubular 112' includes a plurality of flow holes 210. At least one of the flow holes 210 are between the upstream barrier 208 and the upstream end of the upstream housing 108' when the valve assembly 204 is in the first configuration. The flow holes 210, which are configured to enable wellbore fluid to pass therethrough, are positioned such that the tubular plug 118' does not obstruct the flow holes when the tubular plug is in engagement with the upstream barrier 208, as shown by the cross-hatched figure of the tubular plug 118' shown in FIG. 3. In other words, the flow holes 210 are positioned at a location far enough downstream of the upstream barrier 208 such that the tubular plug 118' does not obstruct the flow holes when the tubular string 106' is being run-into the wellbore. As discussed above, the tubular plug 118' will be urged into engagement with the upstream barrier 208 during run-in of the tubular string 106', as the tubular plug is located within the valve tubular 112' and movable between the upstream and downstream barriers 208, 116' Thus, during run-in, the wellbore fluid passing through the valve tubular 112' and into the tubular string 106' will move the tubular plug 118' into engagement with the upstream barrier 208, as shown by the dotted line image. It is to be understood that the flow holes 210 can be clustered together in one location or spaced circumferentially around the valve tubular 112'. Moreover, one of ordinary skill in the art will recognize that the flow holes 210 must be sized appropriately to ensure that the tubular plug 118' is unable to become dislodged or displaced because of the flow holes.

The flow holes 210 help minimalize the flow obstruction stemming from the location of the tubular plug 118' within the valve tubular 112'. In addition, the upstream end of the valve tubular 112' can be open and the tubular plug 118' sized appropriately to enable wellbore fluid to pass between the tubular plug and the valve tubular while still allowing for the upstream barrier 208 (which may be a bolt as discussed above) to prevent removal of the tubular plug from the valve tubular. Such an arrangement further minimalizes the flow obstruction stemming from the location of the tubular plug 118' within the valve tubular 112'.

After the tubular string 106' is run-into the wellbore to the desired depth, a subsequent cementing operation is performed to fill the annular area between the casing and the wellbore with cement. Before commencing the cementing operation, the valve assembly 204 must be converted from the first configuration (in which wellbore fluids outside of the tubular string 106' are permitted to flow into the tubular string via the valve tubular 112') to the second configuration (in which the valve assembly acts a one-way check valve that only allows fluids within the tubular string to be expelled from the tubular string). As discussed above, fluid pumped downstream within the tubular string 106' urges the tubular plug 118' away from the upstream barrier 208 and towards the downstream barrier 116'. Continued pumping of fluid downstream within the tubular string 106' will seat the tubular plug 118' within the downstream barrier 116', forming a fluid-tight seal between the tubular plug and the downstream barrier such that fluids cannot pass thereby.

After the tubular plug 118' is seated within the downstream barrier 116', the hydrostatic pressure within the tubular string 106' can be increased. The increasing hydrostatic pressure within the tubular string 106' forces the tubular plug 118' against the downstream barrier 116'. After the pressure within the tubular string 106' reaches a certain threshold, the tubular plug 118' exerts enough force against the downstream barrier 116' to shear the shear pins 130' connecting the valve tubular 112' to the upstream housing 108', thereby releasing the valve tubular from the upstream housing.

After the valve tubular 112' is released, the valve tubular is pushed downstream within the well by fluid being pumped through the tubular string such that the valve tubular is ejected from the upstream and downstream housings 108', 110'. The ejection of the valve tubular 112' from the upstream and downstream housings 108', 110' permits flapper 124' and flapper 132' to close, thereby converting the valve assembly 204 from the first configuration to the second configuration.

Similar to valve assembly 104, the valve assembly 204' has a reduced likelihood of a failure to convert from the first configuration to the second configuration because the tubular plug 118' is located within the valve tubular 112' and the upstream and downstream barriers 208, 116' are positioned to prevent the tubular plug from being removed from the valve tubular. The restricted movement of the tubular plug 118' between the upstream and downstream barriers 208, 116' makes it more likely that the tubular plug will form a proper seal with the downstream barrier 116', enabling the tubular string to be pressurized for conversion of the valve assembly 204. In some situations, however, the tubular plug 118' may still fail to engage the downstream barrier 116' in a manner that enables the tubular string 106' to be pressurized to release the valve tubular 112' from the upstream housing 108' and convert the valve assembly 204. In such a situation, the upstream portion 206 of the valve tubular 112' provides an alternative manner of releasing, and ultimately ejecting, the valve tubular from the housings 108', 112' during the cementing operation.

During the cementing operation, the cement slurry is preferably isolated or separated from other fluids within the tubular string. Accordingly, the cementing operation is typically commenced by pumping a first cementing plug 212 downstream before introducing the cement slurry into the tubular string 106'. The first cementing plug 212 may include one or more fins around its circumference, the fins helping separate fluids downstream of the first cementing plug from the cement slurry upstream of the first cementing plug. The first cementing plug 212 is pumped downstream until the first cementing plug rests on the upstream end of the upstream housing 108' of the float collar 100'. Because the upstream portion 206 of the valve tubular 112' extends upstream from the upstream end of the upstream housing 108', the first cementing plug 212 must contact the upstream portion of the valve tubular before resting on the upstream housing. Upon contacting the upstream portion 206 of the valve tubular 112', the first cementing plug 212 exerts a force on the valve tubular 112'. As hydrostatic pressure upstream of the first cementing plug 212 continues to be increased, the first cementing plug exerts an increasing force on the valve tubular 112' until the shear pins 130' connecting the tubular to the upstream housing 108' are sheared, thereby releasing the valve tubular from the upstream housing.

After the valve tubular 112' is released from the upstream housing 108', the valve tubular can be pumped downstream and ejected from the upstream and downstream housings 108', 110'. Ejection of the valve tubular 112' from the housings permits flapper 124' and flapper 132' to close, thereby converting the valve assembly 204 from the first configuration to the second configuration. As such, in the event that the seating of the tubular plug 118' within the downstream barrier 116' fails to enable the valve assembly 204 to be converted from the first configuration to the secondary configuration, the upstream portion 206 of the valve tubular 112' provides an alternative manner for converting the valve assembly to ensure that float collar 100' does not allow reverse flow of cement slurry during a cementing operation.

Releasing the valve tubular 112' from the upstream housing 108' also permits the first cementing plug 212 to rest on the upstream housing. Upon resting on the upstream housing 108', a rupture membrane of the first cementing plug 212 can be ruptured by the hydrostatic pressure building on the upper side of the rupture membrane. Once the first cementing plug 212 reaches a rupture pressure, the rupture membrane ruptures, and the cement slurry flows through the bore of the first cementing plug, through the upstream and downstream housings of the float collar, and into the annulus.

Because the interaction between the first cementing plug 212 and the upstream portion 206 of the valve tubular 112' provides the alternative manner of converting the valve assembly 204 from the first configuration to the second configuration, the valve assembly does not require any additional steps before commencing the cementing operation to verify the valve tubular has been ejected from the housings 108', 110'. Valve assembly 104 discussed above requires the release of secondary plug 146 in the event that the tubular plug 118 fails to enable the valve assembly 104 to be converted from the first configuration to the second configuration. As such, an additional step is required before commencing the cementing operation in order to utilize the alternative manner of converting the valve assembly 104. Valve assembly 204, however, does not require an additional step. Rather, in the event that the tubular plug 118' has failed to enable the valve assembly 204 to be converted from the first configuration to the second configuration, the alternative manner of converting the valve assembly 204 will automatically be activated upon the commencement of the cementing operation.

In one or more of the foregoing embodiments, the valve assembly convertible from a first configuration to a second configuration includes a housing, a flapper attached to the housing adjustable between an open position and a closed position, a tubular releasably connected to the housing, an upstream barrier attached to the tubular, a downstream barrier attached to the tubular, and a tubular plug located within the tubular and movable between the upstream and downstream barriers. The flapper is in the open position when the valve assembly is in the first configuration and in the closed position when the valve assembly is in the second configuration. The tubular is connected to the housing when the valve assembly is in the first configuration and released from the housing when the valve assembly is in the second configuration. The upstream and downstream barriers are positioned to prevent removal of the tubular plug from the tubular.

In one or more of the foregoing embodiments, the housing includes an upstream end and a downstream end. An upstream portion of the tubular extends past the upstream end of the housing when the valve assembly is in the first configuration.

In one or more of the foregoing embodiments, the upstream portion of the tubular includes at least one flow hole formed in a wall of the tubular.

In one or more of the foregoing embodiments, the upstream barrier is a bolt, and the tubular plug is sized to be positionable between the upstream barrier and the at least one flow hole.

In one or more of the foregoing embodiments, a downstream portion of the tubular opens the flapper when the valve assembly is in the first configuration.

In one or more of the foregoing embodiments, the housing is an upstream housing and the valve assembly further comprises a downstream housing. The downstream housing includes a flapper adjustable between an open position and a closed position. The flapper of the downstream housing is in the open position when the valve assembly is in the first configuration and in the closed position when the valve assembly is in the second configuration.

In one or more of the foregoing embodiments, the upstream barrier includes an upstream plug catcher including a flow opening. The upstream plug catcher is configured to receive a secondary plug flowing downstream within a well to thereby form a seal between the upstream plug catcher and the secondary plug.

In one or more of the foregoing embodiments, the upstream plug catcher further includes a protrusion configured to prevent the tubular plug from sealing the flow opening when the tubular plug engages the upstream plug catcher.

In one or more of the foregoing embodiments, the upstream and downstream plug catchers are attached to an interior surface of the tubular.

In one or more of the foregoing embodiments, the housing includes a connection collar configured to releasably connect the tubular to the housing. The upstream plug catcher is located downstream of the connection collar.

In one or more of the foregoing embodiments, a float collar includes a body configured to be attached to a tubular string; and a valve assembly positioned within the body. The valve assembly includes a housing attached to an interior surface of the body, a flapper attached to the housing and adjustable between an open position and a closed position, a tubular releasably connected to the housing, an upstream barrier attached to the tubular, a downstream barrier attached to the tubular and a tubular plug located within the tubular and movable between the upstream and downstream barriers. A downstream portion of the tubular holds the flapper in the open position. The upstream and downstream barriers are positioned to prevent removal of the tubular plug from the tubular. The float collar is configured to enable fluid to flow through the tubular and into the tubular string while the tubular string is being run into a well.

In one or more of the foregoing embodiments, the housing of the valve assembly includes an upstream end and a downstream end, and an upstream portion of the tubular extends from the upstream end of the housing when the tubular is connected to the housing.

In one or more of the foregoing embodiments, the upstream barrier is axially spaced from the upstream end of the housing when the tubular is connected to the housing by an axial distance greater than an axial length of the tubular plug.

In one or more of the foregoing embodiments, the upstream portion of the tubular includes at least one fluid flow hole, the at least one fluid flow hole being positioned such that fluid can pass therethrough when the tubular plug is in engagement with the upstream barrier.

In one or more of the foregoing embodiments, the upstream barrier is a bolt.

In one or more of the foregoing embodiments, the upstream barrier is an upstream plug catcher including a flow opening. The upstream plug catcher is configured to receive a secondary plug flowing downstream within a well to thereby form a seal between the upstream plug catcher and the secondary plug.

In one or more of the foregoing embodiments, the upstream plug catcher further includes a protrusion configured to prevent the tubular plug from sealing the flow opening when the tubular plug engages the upstream plug catcher during run-in of the tubular string.

In one or more of the foregoing embodiments, a method of converting a valve assembly includes running a tubular string into a well, retaining the valve assembly in an open position using a valve tubular releasably attached to the housing, and pumping fluid downstream through the tubular string to urge a tubular plug away from an upstream barrier and into engagement with a downstream barrier. The tubular string has a float collar attached to a bottom end thereof. The valve assembly is oriented within the float collar and includes a housing. A tubular plug is located within the valve tubular and upstream and downstream barriers are connected to the valve tubular to prevent removal of the tubular plug from the valve tubular.

In one or more of the foregoing embodiments, the upstream barrier includes a plug catcher and a secondary plug is pumped downstream through the tubular string. The method of converting the valve assembly further includes landing the secondary plug on the plug catcher, and increasing hydrostatic pressure to release the valve tubular from the housing.

In one or more of the foregoing embodiments, a secondary plug is pumped downstream through the tubular string after the tubular plug fails to engage the downstream barrier in a manner that enables hydrostatic pressure within the tubular string to be increased to a level sufficient to release the valve tubular from the housing. The secondary plug is a first cementing plug that forcibly contacts an upper portion of the valve tubular to release the valve tubular from the housing.

In the foregoing description, the terms "upstream" and "downstream" are used to describe the relative location of a component within a well, regardless of whether the well is orientated substantially vertical or substantially horizontal. For example, a downstream housing is displaced further within a well relative to an upstream housing. Similarly, a downstream end is displaced further within a well relative to an upstream end. While the foregoing description is directed to embodiments of the present disclosure, other and further embodiments may be devised without departing from the basic scope thereof. Various components of the disclosure may be capable of modification or alteration in form and function by a person of ordinary skill in the art without departing from the scope of the disclosure. Consequently, the embodiments described herein are not intended to be limiting to the spirit and scope of the attached claims.

I claim:

1. A valve assembly convertible from a first configuration to a second configuration, the valve assembly comprising:

a housing;

a flapper attached to the housing adjustable between an open position and a closed position, the flapper being in the open position when the valve assembly is in the first configuration and in the closed position when the valve assembly is in the second configuration;

a tubular releasably connected to the housing, the tubular being connected to the housing when the valve assembly is in the first configuration and released from the housing when the valve assembly is in the second configuration, wherein a portion of the tubular holds the flapper in the open position when the valve assembly is in the first configuration;

an upstream barrier attached to the tubular;

a downstream barrier attached to the tubular;

a tubular plug located within the tubular and movable between the upstream and downstream barriers, the upstream and downstream barriers positioned to prevent removal of the tubular plug from the tubular;

a first fluid bypass configured to allow flow around the tubular plug when the tubular plug is engaged with the downstream barrier; and a second fluid bypass configured to allow flow around the tubular plug when the tubular plug is engaged with the upstream barrier.

2. The valve assembly of claim 1 wherein the housing includes an upstream end and a downstream end, an upstream portion of the tubular extending past the upstream end of the housing when the valve assembly is in the first configuration.

3. The valve assembly of claim 2 wherein the upstream portion of the tubular includes the second fluid bypass, wherein the second fluid bypass is at least one flow hole formed in a wall of the tubular.

4. The valve assembly of claim 3 wherein the upstream barrier is a bolt, and the tubular plug is sized to be positionable between the upstream barrier and the at least one flow hole.

5. The valve assembly of claim 2 wherein the housing is an upstream housing and the valve assembly further comprises a downstream housing, the downstream housing including a flapper adjustable between an open position and a closed position, the flapper of the downstream housing being in the open position when the valve assembly is in the first configuration and in the closed position when the valve assembly is in the second configuration.

6. The valve assembly of claim 1 wherein the upstream barrier comprises an upstream plug catcher including a flow opening, the upstream plug catcher being configured to receive a secondary plug flowing downstream within a well to thereby form a seal between the upstream plug catcher and the secondary plug.

7. The valve assembly of claim 6 wherein the upstream plug catcher further includes the second fluid bypass, wherein the second fluid bypass is a protrusion configured to prevent the tubular plug from sealing the flow opening when the tubular plug engages the upstream plug catcher.

8. The valve assembly of claim 7 wherein the upstream and downstream plug catchers are attached to an interior surface of the tubular.

9. The valve assembly of claim 6 wherein the housing includes a connection collar configured to releasably connect the tubular to the housing, the upstream plug catcher located downstream of the connection collar.

10. The valve assembly of claim 1, wherein the upstream barrier is configured to receive a secondary plug.

11. A float collar comprising:

a body configured to be attached to a tubular string; and a valve assembly positioned within the body, the valve assembly including:

a housing attached to an interior surface of the body;

a flapper attached to the housing and adjustable between an open position and a closed position;

a tubular releasably connected to the housing, a downstream portion holding the flapper in the open position;

an upstream barrier attached to the tubular;

a downstream barrier attached to the tubular;

a tubular plug located within the tubular and movable between the upstream and downstream barriers, the upstream and downstream barriers positioned to prevent removal of the tubular plug from the tubular;

a first fluid bypass configured to allow flow around the tubular plug when the tubular plug is engaged with the downstream barrier; and a second fluid bypass configured to allow flow around the tubular plug when the tubular plug is engaged with the upstream barrier;

wherein the float collar is configured to enable fluid to flow through the tubular and into the tubular string while the tubular string is being run into a well; and wherein the flapper is configured to move from the open position to the closed position after the tubular is released from the housing.

12. The float collar of claim 11 wherein the housing of the valve assembly includes an upstream end and a downstream end, and an upstream portion of the tubular extends from the upstream end of the housing when the tubular is connected to the housing.

13. The float collar of claim 12 wherein the upstream barrier is axially spaced from the upstream end of the housing when the tubular is connected to the housing by an axial distance greater than an axial length of the tubular plug.

14. The float collar of claim 12 wherein the upstream portion of the tubular includes the second fluid bypass, wherein the second fluid bypass is at least one fluid flow hole positioned such that fluid can pass therethrough when the tubular plug is in engagement with the upstream barrier.

15. The float collar of claim 14 wherein the upstream barrier is a bolt.

16. The float collar of claim 12 wherein the upstream barrier is an upstream plug catcher including a flow opening, the upstream plug catcher being configured to receive a secondary plug flowing downstream within a well to thereby form a seal between the upstream plug catcher and the secondary plug.

17. The float collar of claim 16 wherein the upstream plug catcher further includes the second fluid bypass, wherein the second fluid bypass is a protrusion configured to prevent the tubular plug from sealing the flow opening when the tubular plug engages the upstream plug catcher during run-in of the tubular string.

18. A method of converting a valve assembly, the method comprising:

running a tubular string into a well, the tubular string having a float collar attached to a bottom end thereof, the valve assembly being oriented within the float collar and including a housing;

retaining the valve assembly in an open position using a valve tubular releasably attached to the housing and allowing the closure of the valve assembly after the valve tubular is released from the housing, wherein a tubular plug is located within the valve tubular and an upstream barrier and a downstream barrier are connected to the valve tubular to prevent removal of the tubular plug from the valve tubular;

allowing fluid to bypass the tubular plug when the tubular plug engages the upstream barrier during the running in of the valve assembly into the well with a first fluid bypass; and pumping fluid downstream through the tubular string to urge the tubular plug away from the upstream barrier and into engagement with the downstream barrier, and wherein a second fluid bypass allows fluid to bypass the tubular plug after the tubular plug engages the downstream barrier.

19. The method of claim 18 wherein the upstream barrier includes a plug catcher and the method further comprises:

pumping a secondary plug downstream through the tubular string after the tubular plug fails to engage the downstream barrier in a manner that enables hydrostatic pressure within the tubular string to be increased to a level sufficient to release the valve tubular from the housing;

landing the secondary plug on the plug catcher; and increasing hydrostatic pressure to release the valve tubular from the housing.

20. The method of claim 18 wherein the method comprises pumping a secondary plug downstream through the tubular string after the tubular plug fails to engage the downstream barrier in a manner that enables hydrostatic pressure within the tubular string to be increased to a level sufficient to release the valve tubular from the housing, the secondary plug being a first cementing plug that forcibly contacts an upper portion of the valve tubular to release the valve tubular from the housing.

* * * * *